US012600534B2

(12) United States Patent
Wyne

(10) Patent No.: US 12,600,534 B2
(45) Date of Patent: Apr. 14, 2026

(54) SPOUT CONNECTOR REINFORCEMENT RING ASSEMBLY

(71) Applicant: Mark W. Wyne, Wildwood, MO (US)

(72) Inventor: Mark W. Wyne, Wildwood, MO (US)

(73) Assignee: Mark W. Wyne, Wildwood, MO (US)

( * ) Notice: Subject to any disclaimer, the term of this patent is extended or adjusted under 35 U.S.C. 154(b) by 179 days.

(21) Appl. No.: 18/425,237

(22) Filed: Jan. 29, 2024

(65) Prior Publication Data

US 2024/0253871 A1 Aug. 1, 2024

Related U.S. Application Data

(60) Provisional application No. 63/441,635, filed on Jan. 27, 2023.

(51) Int. Cl.
*B65D 47/06* (2006.01)

(52) U.S. Cl.
CPC ..... *B65D 47/065* (2013.01); *B65D 2547/066* (2013.01)

(58) Field of Classification Search
CPC ..... B65D 47/065; B65D 2547/066; B65D 25/48; B67D 7/005
See application file for complete search history.

(56) References Cited

U.S. PATENT DOCUMENTS 1,593,016 A * 7/1926 Campbell ..... B65D 25/48 138/135
2,904,232 A * 9/1959 Gersten ..... B65D 47/061 222/542
4,600,125 A * 7/1986 Maynard, Jr. ..... B67C 11/00 141/330
5,020,702 A * 6/1991 James ..... B67C 11/04 222/529
5,350,091 A * 9/1994 Leete ..... B67D 7/005 222/529
D404,462 S 1/1999 Otto
D526,383 S 8/2006 Byerly
D667,530 S 9/2012 Wyne
D691,709 S 10/2013 Franzino et al.
D698,415 S 1/2014 Wyne
D699,320 S 2/2014 Wyne
D733,558 S 7/2015 Wyne
D737,410 S 8/2015 Wyne
D887,836 S 6/2020 Westcott-Pocock
D923,140 S 6/2021 Yu
D1,045,605 S 10/2024 Gillette
2004/0035819 A1* 2/2004 Dennison ..... B65D 47/065 215/386

(Continued)

FOREIGN PATENT DOCUMENTS

CA 2187379 A1 * 4/1998 ..... B65D 47/06
EP 0198790 A1 * 10/1986 ..... B29C 49/00

(Continued)

*Primary Examiner* — Bob Zadeh

(74) *Attorney, Agent, or Firm* — Sandberg Phoenix & von Gontard, P.C.

(57) ABSTRACT

A spout connector and reinforcement ring assembly includes a rigid ring that is positioned around an exterior surface of an input connector of the spout and prevents expansion of the input connector as the input connector is screw threaded on a threaded opening of a container.

18 Claims, 3 Drawing Sheets

(56) References Cited

U.S. PATENT DOCUMENTS

| | | | | |
|---|---|---|---|---|
| 2011/0084090 | A1* | 4/2011 | MacDougall | B65D 47/061 222/481.5 |
| 2013/0048683 | A1 | 2/2013 | Nufer et al. | |
| 2013/0056505 | A1* | 3/2013 | Cress | B65D 47/06 29/402.08 |
| 2024/0253871 | A1* | 8/2024 | Wyne | B65D 47/065 |

FOREIGN PATENT DOCUMENTS

| | | | | |
|---|---|---|---|---|
| KR | 101691133 | B1 * | 12/2016 | B65D 25/48 |
| WO | WO-2015176128 | A1 * | 11/2015 | B65D 7/06 |

* cited by examiner

SPOUT CONNECTOR REINFORCEMENT RING ASSEMBLY

CROSS-REFERENCE TO RELATED APPLICATION

This patent application claims the benefit of the filing date of the provisional patent application Ser. No. 63/441,635, filed Jan. 27, 2023.

BACKGROUND

Dispensing spouts are commonly provided with a threaded connector at one end, an input end of the spout that is opposite a dispensing tip at an opposite output end of the spout. The threaded connector is configured to be removably attachable to a threaded dispenser opening of a container containing a liquid. With the threaded connector of the spout attached to the threaded dispenser opening of the container, the liquid contents of the container can be dispensed through the spout.

A problem encountered when connecting a threaded connector of a spout constructed of a flexible material, for example a plastic material, to the threaded dispenser opening of a container constructed of a more rigid material such as metal is that the flexible material of the threaded connector will at times expand when tightening the threaded connector of the spout on the threaded dispenser opening of the container. The expansion of the threaded connector of the spout causes the internal threads of the threaded connector to ride up and pass over the external threads of the threaded dispenser opening of the container. This expansion of the threaded connector of the spout prevents obtaining a desired tight fit of the threaded connector of the spout on the threaded dispenser opening of the container.

SUMMARY

The spout connector and reinforcement ring assembly of this disclosure is comprised of a spout and a separate reinforcement ring. The reinforcement ring is removably attachable on an input end of the spout. The reinforcement ring is dimensioned and configured to fit over the exterior of a threaded connector at one end or the input end of the spout. The reinforcement ring is constructed of a material that is more rigid and less flexible than the material of the spout. By positioning and attaching the reinforcement ring over the exterior surface of the threaded connector at the input end of the spout prior to the threaded connector of the spout being screw threaded on the threaded dispenser opening of a container, the rigid material of the reinforcement ring prevents the expansion of the threaded connector at the input end of the spout and thereby enables the threaded connector at the input end of the spout to be screwed down onto the threaded dispenser opening of the container and obtaining a tight fit of the internal screw threads of the threaded connector over the external screw threads of the threaded dispenser opening of the container.

The features, functions and advantages that have been discussed can be achieved independently in various embodiments or may be combined in yet other embodiments, further details of which can be seen with reference to the following drawings and description.

DRAWING FIGURES

Further objects and features of the spout connector reinforcement ring assembly are set forth in the following detailed description of the assembly and in the drawing figures.

Figure 9:
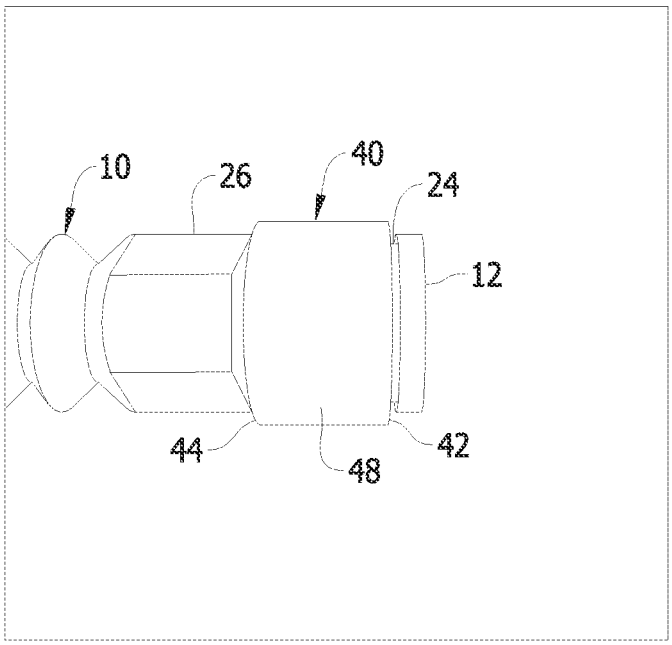

FIG. 9. is a representation of a side elevation view of the threaded connector of the spout with the reinforcement ring positioned in its operative position on the exterior of the threaded connector of the spout.

Figure 10:
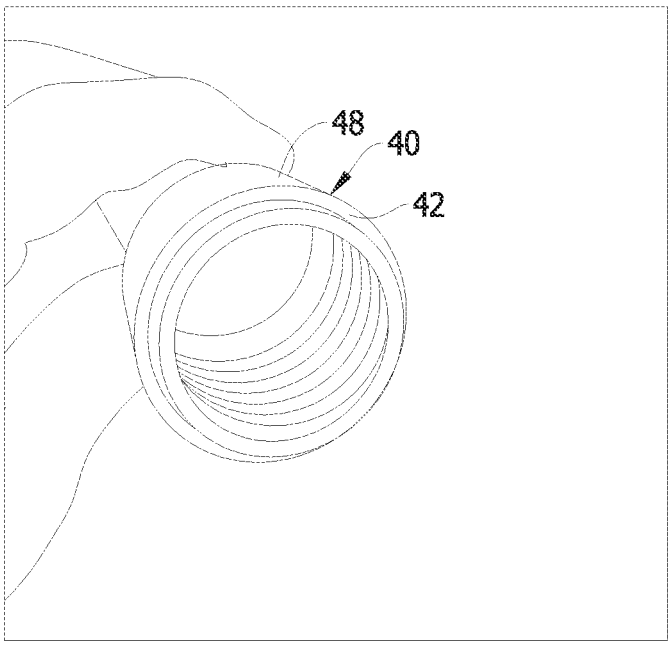

FIG. 10 is a representation of an end perspective view of the threaded connector of the spout with the reinforcement ring positioned on the exterior of the threaded connector of the spout.

DESCRIPTION

FIGS. 1-7 are representations of the spout 10 of the spout connector and reinforcement ring assembly of this disclosure. As shown, the spout 10 has an elongate length that extends between an input end 12 and an opposite output end 14 of the spout. The spout 10 in a preferred environment is constructed of a flexible, fluid tight material, for example a plastic material. The material of the spout gives the spout a rigidity property and a flexibility property. Other equivalent types of materials could be used in constructing the spout 10. The spout 10 has a cylindrical configuration with a hollow interior bore 16 that extends through the length of the spout 10 between the input end 12 and the output end 14.

An input connector 18 is formed integrally on the input end 12 of the spout 10. The input connector 18 is an input threaded connector. The input connector 18 is formed with internal screw threads 22 that surround and form a portion of the interior bore 16 of the spout 10. The input connector 18 is also formed with external screw threads 24 that are opposite the internal screw threads 22. The external screw threads 24 form an exterior surface 24 of the input connector 18. In variant embodiments of the invention, the external screw threads 24 are replaced by a cylindrical exterior surface 24 at the input end 12 of the spout 10 that surrounds the internal screw threads 22 of the input connector 18.

A torque surface 26 is formed on the exterior of the spout 10 adjacent the exterior surface 24 of the input connector 18. The torque surface 26 has an exterior surface configuration that facilitates the transmission of a turning or screwing force to the input connector 18 when attaching the spout 10 to a separate container as will be explained. As represented in the FIGS., the torque surface 26 has a hexagonal configuration. The torque surface 26 could have other equivalent configurations, for example a knurled configuration.

A portion of the length of the spout 10 adjacent to the torque surface 26 is formed in a pleated or accordion type configuration. This configuration of portion 28 of the spout 10 enhances the flexibility of the spout 20 and enables the spout 20 to be more easily bent from side to side along its length. Portion 28 of the spout 10 could be provided with other equivalent types of configurations that enhance the flexibility and the ability of the spout 10 to bend along its length.

A first output threaded connector 32 and a second output threaded connector 34 are formed on the exterior surface of the spout 10 adjacent the output end 14 of the spout. As represented in the FIGS., the first output threaded connector 32 has a large exterior diameter dimension and a large exterior circumference dimension. The second output threaded connector 34 has a small exterior diameter dimension and a small exterior circumference dimension compared to those of the first output threaded connector 32. Both the first output threaded connector 32 and the second output threaded connector 34 are configured to enable the output end 14 of the spout 10 to be attached to internal screw threaded connectors having different internal diameter dimensions.

Figure 1:
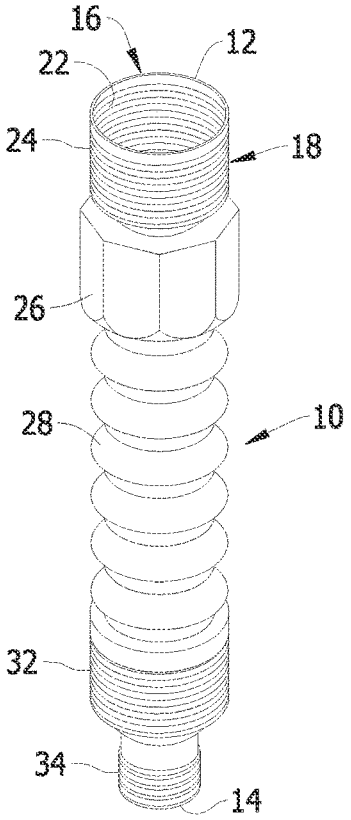
FIG. 1 is a representation of a perspective view of the spout of this disclosure.
Figure 2:
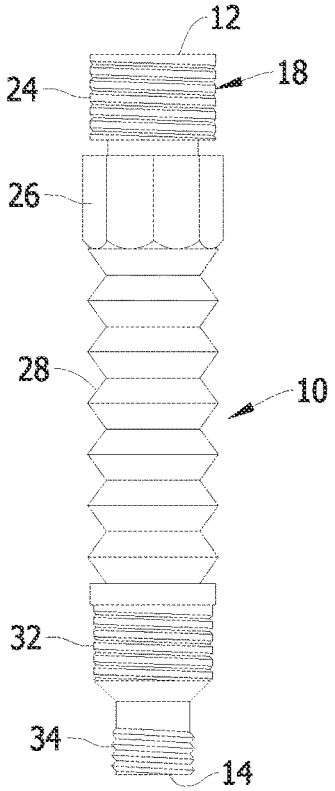
FIG. 2 is a representation of a front elevation view of the spout of FIG. 1.
Figure 3:
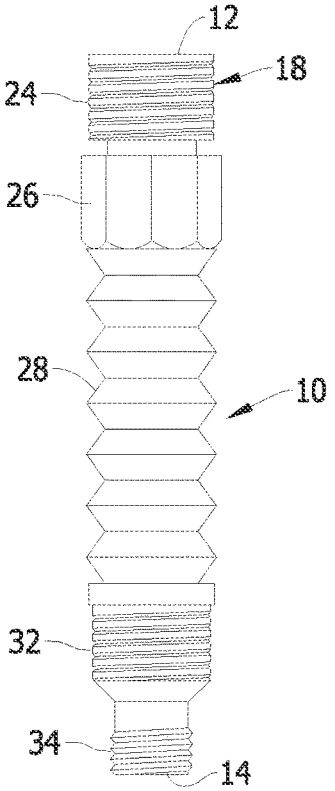
FIG. 3 is a representation of a rear elevation view of the spout of FIG. 2.
Figure 4:
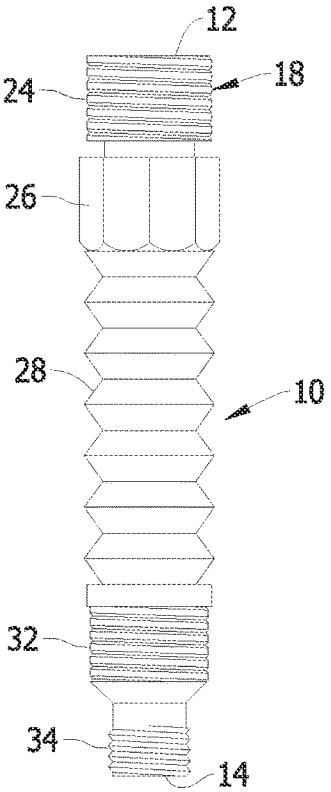
FIG. 4 is a representation of a right side elevation view of the spout of FIG. 2.
Figure 5:
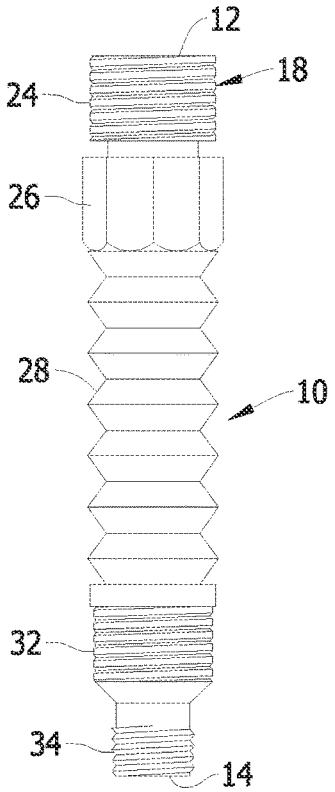
FIG. 5 is a representation of a left side elevation view of the spout of FIG. 2.
Figure 6:
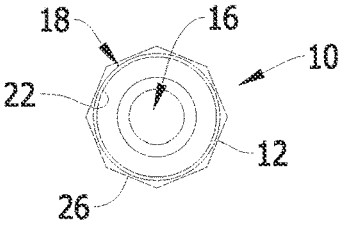
FIG. 6 is a representation of a top plan view of the spout of FIG. 2.
Figure 7:
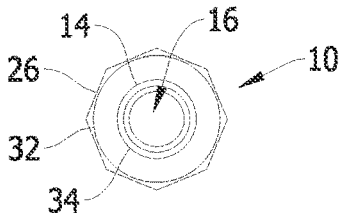
FIG. 7 is representation of a bottom plan view of the spout of FIG. 2
Figure 8:
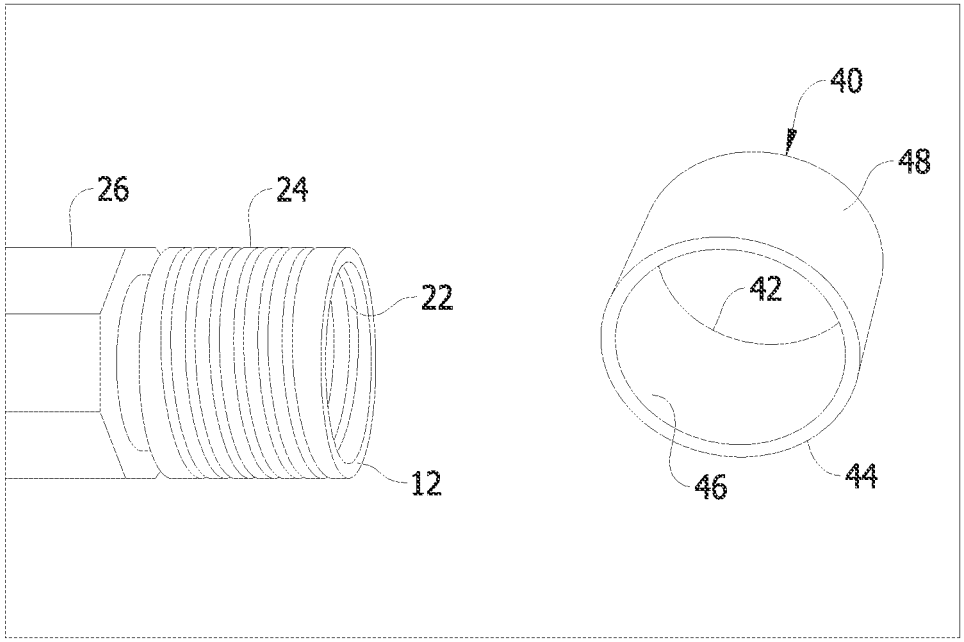
FIG. 8 is a representation of a side elevation view of the threaded connector of the spout and the reinforcement ring of this disclosure.

The ring 40 of the spout connector and reinforcement ring assembly is a separate part from the spout 10 and is represented in FIGS. 8-10. The ring 40 is constructed of a rigid material that gives the ring a rigidity property that is greater than the rigidity property of the spout 10, and more specifically gives the ring 40 a rigidity that is greater than a rigidity of the input connector 18 of the spout 10. Additionally, the spout 10 has a flexibility property that is greater than a flexibility property of the ring 40. With the spout 10 being more flexible than the ring 40, the spout has an expansion ability or property that is greater than an expansion ability or property of the ring 40. The ring 40 could be constructed of a plastic material or other equivalent type of material. The ring 40 has a cylindrical configuration and a length that extends between an input end 42 of the ring and an opposite output end 44 of the ring. The cylindrical configuration of the ring 40 gives the ring a flat and smooth cylindrical interior surface 46 and an opposite flat and smooth cylindrical exterior surface 48. The interior surface 46 of the ring 40 is dimensioned to fit in a sliding friction surface engagement over and with the exterior surface 24 of the input connector 18 of the spout 10.

As represented in FIG. 8, the external screw threading of the exterior surface 24 of the input connector 18 is formed with flat exterior surfaces rather than arched exterior surfaces to enhance and increase the area of surface contact between the flat, cylindrical interior surface 46 of the ring 40 and the exterior surface 24 of the input connector 18. As represented in FIG. 9, the ring 40 has a length between the input end annular surface 42 and the output end annular surface 44 of the ring that enables the interior surface 46 of the ring to extend over and engage in friction engagement over substantially all of the exterior surfaces 24 of the exterior screw threads of the input connector 18. With the ring 40 positioned on the exterior screw threads or exterior surface 24 of the input connector 18, the output end 44 of the ring 40 is positioned toward and in surface engagement with the torque surface 26 of the spout 10 and the input end 42 of the ring 40 is positioned toward the input end 12 of the spout 10. This enables one end of the torque surface 26 to engage against and push axially against the annular output end surface 44 of the ring 40 when tightening the input connector 18 on a separate dispenser opening of a container.

In use of the spout connector and reinforcing ring assembly of this disclosure, when it is desired to use the assembly to dispense a liquid from a container, the input connector 18 of the spout 10 is attached to a threaded dispenser opening of the container in a conventional manner. The internal screw threads 22 of the input connector 18 are positioned adjacent to and then screwed on the external screw threads of the threaded dispenser opening of the container.

If as the input connector 18 is screw threaded on the threaded opening of the container it is noted that the relative dimensions of the threaded opening of a container and the internal screw threads 22 of the input connector 18 cause the input connector to expand radially outward. When the radial expansion is too great it can cause the internal screw threads 22 to pass over the external screw threads of the threaded dispenser opening of the container. In this situation, the ring 40 of the assembly can be positioned on the exterior screw threads or exterior surface 24 of the input connector 18 to prevent the expansion. The interior surface 46 of the ring 40 engages in surface contact around the exterior surface 24 of the screw threads of the input connector 18. With the ring 40 having a greater rigidity or being more rigid and less flexible than the input connector 18, and the ring 40 having a lesser flexibility or being less flexible than the input connector 18, the ring 40 prevents the internal screw threads 22 of the input connector 18 and the external screw threads 24 of the input connector from radially expanding as the input connector is screw threaded on or attached on the threaded dispenser opening of the container. With the ring 40 in place on the exterior surface 24 of the input connector 18, the input connector 18 can be screw threaded on the threaded dispenser opening of the container in a tight fit around the threaded opening. The ring 40 positioned on the exterior surface 24 of the input connector 18 prevents the radial expansion of the input connector 18 as the connector is screw threaded onto the threaded dispenser opening of the container, ensuring a tight friction fit between the internal screw threads 22 of the input connector 18 and the external screw threads of the threaded dispenser opening of the container.

As various modifications could be made in the construction of the spout connector reinforcement ring assembly and its method of operation here and described and illustrated without the parting from the scope of the invention, it is intended that all matter contained in the foregoing description or shown in the accompanying drawings shall be interpreted as illustrative rather than limiting. Thus, the breadth and scope of the present disclosure should not be limited by any of the above described exemplary embodiments, but should be defined only in accordance with the following claims appended hereto and their equivalents.

The invention claimed is:

1. A spout connector and reinforcement ring assembly comprising:

a spout;

an input connector on the spout, the input connector having internal screw threads and the input connector having an exterior surface that extends around the internal screw threads of the input connector;

a ring, the ring and the spout being separate parts with the ring being separable from the spout, the ring being removably positioned on and in engagement over the input connector, the ring is positioned on the exterior surface of the input connector, the ring being operable to prevent expansion of the input connector as the input connector is positioned on an opening of a container;

a torque surface on an exterior of the spout, the torque surface being adjacent to and separate from the input connector, the torque surface being configured for transmitting a turning, screwing force to the input connector connector on the opening of the container.

2. The spout connector and reinforcement ring assembly of claim 1, further comprising:

the ring having a cylindrical interior surface that engages in surface contact with the exterior surface of the input connector.

3. The spout connector and reinforcement ring assembly of claim 1, further comprising:

the spout being constructed of a flexible material; and the ring being constructed of a material that is less flexible than the flexible material of the spout.

4. The spout connector and reinforcement ring assembly of claim 1, further comprising:

the input connector being constructed of a flexible material; and the ring being constructed of a material that is less flexible than the flexible material of the input connector.

5. The spout connector and reinforcement ring assembly of claim 1, further comprising:

the torque surface having a hexagonal exterior surface configuration.

6. The spout connector and reinforcement ring assembly of claim 1, further comprising:

the ring having interior surface threads that is configured to engage around exterior surface threads of the input connector and prevent expansion of the input connector as the input connector is positioned on the opening of the container.

7. The spout connector and reinforcement ring assembly of claim 6, further comprising:

the ring being constructed of a material having a first rigidity;

the input connector being constructed of a material having a second rigidity;

and the first rigidity being more rigid than and greater than the second rigidity.

8. The spout connector and reinforcement ring assembly of claim 6, further comprising:

the ring being constructed of a material having a first flexibility;

the input connector being constructed of a material having a second flexibility;

and the first flexibility being less flexible than the second flexibility.

9. The spout connector and reinforcement ring assembly of claim 1, further comprising:

the spout having a length with an input end and an output end at opposite ends of the length of the spout;

the input connector formed on the input end of the spout;

a first output connector and a second output connector formed on the output end of the spout; and the first output connector having a larger exterior diameter dimension than the second output connector.

10. The spot connector and reinforcement ring connector of claim 1, further comprising: the torque surface being a knurled surface.

11. A spout connector and reinforcement ring assembly comprising:

a spout, the spout being constructed of a material having a first rigidity;

an input connector integrally on the spout, the input connector having internal screw threads and the input connector having a cylindrical exterior surface that extends around the internal screw threads;

a ring, the ring being constructed of a material having a second rigidity, the second rigidity being greater than the first rigidity; and the ring being positioned on and fitting over the cylindrical exterior surface of the input connector and being operable to prevent radial expansion of the input connector as the input connector is positioned on a dispenser opening of a container;

a torque surface on an exterior of the spout, the torque surface being adjacent to and separate from the input connector, the torque surface being configured for transmitting a turning, screwing force to the input connector, connector on the opening of the container.

12. The spout connector and reinforcement ring assembly of claim 11, further comprising:

the spout and the ring are separate parts, with the ring being separable from the spout.

13. The spout connector and reinforcement ring assembly of claim 11, further comprising:

the ring has a flat, cylindrical interior surface that engages in surface engagement with the exterior surface of the input connector.

14. The spout connector and reinforcement ring assembly of claim 13, further comprising:

screw threads on the exterior surface of the input connector, the screw threads having flat, cylindrical exterior surfaces; and the flat, cylindrical interior surface of the ring engages in surface engagement with the flat, cylindrical exterior surfaces of the screw threads on the exterior surface of the input connector.

15. The spout connector and reinforcement ring assembly of claim 11, further comprising:

the spout being constructed of a material having a first flexibility;

the ring being constructed of a material having a second flexibility; and the first flexibility being greater than the second flexibility.

16. The spout connector and reinforcement ring assembly of claim 11, further comprising:

the torque surface having an exterior surface with a hexagonal configuration.

17. The spout connector and reinforcement ring assembly of claim 11, further comprising:

the spout having a length with an input end and an output end at opposite ends of the length of the spout;

the input connector formed on the input end of the spout;

a first output connector and a second output connector formed on the output end of the length of the spout; and the first output connector having a larger exterior diameter dimension than the second output connector.

18. The spout connector and reinforcement ring connector of claim 11, further comprising: the torque surface being a knurled surface.

* * * * *